US005765886A

United States Patent [19]

Buchanan, Jr.

[11] Patent Number: 5,765,886

[45] Date of Patent: Jun. 16, 1998

[54] POWER STRIKER WITH INERTIALLY ACTIVATED IMPACT CYCLE

[75] Inventor: Harry C. Buchanan, Jr., Spring Valley, Ohio

[73] Assignee: ITT Automotive Electrical Systems, Inc., Auburn Hills, Mich.

[21] Appl. No.: 900,048

[22] Filed: Jul. 24, 1997

Related U.S. Application Data

[63] Continuation of Ser. No. 575,644, Dec. 20, 1995, abandoned.

[51] Int. Cl.[6] ..... E05B 15/02

[52] U.S. Cl. ..... 292/341.16; 292/DIG. 46

[58] Field of Search ..... 292/DIG. 23, 341.16, 292/241.15, 341.17, DIG. 43, DIG. 46, 340, 341.18

[56] References Cited

U.S. PATENT DOCUMENTS

| | | | |
|---|---|---|---|
| 2,903,288 | 9/1959 | Joachim et al. . | |
| 2,916,319 | 12/1959 | DuBois . | |
| 3,047,326 | 7/1962 | Leslie et al. | 292/341.15 |
| 3,056,619 | 10/1962 | Fox et al. | 292/341.15 |
| 3,312,491 | 4/1967 | Peters . | |
| 3,378,289 | 4/1968 | Beckman et al. . | |
| 3,403,934 | 10/1968 | Butts . | |
| 3,653,154 | 4/1972 | Hayday . | |
| 3,835,678 | 9/1974 | Meyer et al. . | |
| 3,944,266 | 3/1976 | Weaver . | |
| 4,021,064 | 5/1977 | Kruzan et al. . | |
| 4,098,530 | 7/1978 | Edeus . | |
| 4,110,934 | 9/1978 | Zens . | |
| 4,159,138 | 6/1979 | Smith . | |
| 4,313,281 | 2/1982 | Richmond . | |
| 4,414,828 | 11/1983 | Takinami et al. . | |
| 4,462,185 | 7/1984 | Shibuki et al. . | |
| 4,514,001 | 4/1985 | Garcia | 292/341.16 |
| 4,530,185 | 7/1985 | Moriya et al. . | |
| 4,617,757 | 10/1986 | Kagiyama et al. . | |
| 4,618,174 | 10/1986 | Duke . | |
| 4,640,050 | 2/1987 | Yamagishi et al. . | |
| 4,667,991 | 5/1987 | Pebre | 292/DIG. 23 |
| 4,676,537 | 6/1987 | Esser . | |
| 4,707,007 | 11/1987 | Inoh . | |
| 4,738,052 | 4/1988 | Yoshida . | |
| 4,739,585 | 4/1988 | Pickles . | |
| 4,756,566 | 7/1988 | Logas | 292/341.16 |
| 4,762,348 | 8/1988 | Matsumoto | 292/201 |
| 4,775,178 | 10/1988 | Boyko . | |
| 4,842,313 | 6/1989 | Boyko et al. . | |
| 4,852,923 | 8/1989 | Harmon et al. . | |
| 4,862,640 | 9/1989 | Boyko et al. . | |
| 4,869,537 | 9/1989 | Compeau et al. . | |

(List continued on next page.)

FOREIGN PATENT DOCUMENTS

| | | | |
|---|---|---|---|
| 4105684 | 9/1991 | Germany . | |
| 4230985 | 8/1993 | Germany . | |
| 3-59276 | 3/1991 | Japan | 292/DIG. 162 |
| 2213866 | 8/1989 | United Kingdom . | |

*Primary Examiner*—Rodney M. Lindsey
*Attorney, Agent, or Firm*—Thomas W. Twomey; J. Gordon Lewis

[57] ABSTRACT

A power striker apparatus engages a striker with a latch to move the striker with respect to the latch mechanism from a secondary latch position to a primary latch position. A base member supports the striker for movement between a first position and a second position with respect to the latch mechanism. A biasing member urges the base member toward the first position. A drive moves the base member from the first position against the urging of the biasing member toward the second position and selectively releases the base member when in the second position if the striker is in the secondary latch position when the base member reaches the second position, such that the striker snaps back to the first position in response to the urging of the biasing member to inertially drive the striker into the primary latch position with respect to the latch mechanism from the secondary latch position before the moveable closure can move with respect to the opening.

18 Claims, 4 Drawing Sheets

U.S. PATENT DOCUMENTS 4,881,018 11/1989 Kato et al. .
4,887,390 12/1989 Boyko et al. ..... 49/214
4,916,861 4/1990 Schap .
4,982,984 1/1991 Yokota et al. ..... 292/201
4,984,385 1/1991 DeLand .
5,004,280 4/1991 Schap .
5,016,931 5/1991 Jackson .
5,039,925 8/1991 Schap .
5,046,283 9/1991 Compeau et al. .
5,062,241 11/1991 DeLand .
5,063,710 11/1991 Schap .
5,066,056 11/1991 Schap ..... 292/341.16
5,069,000 12/1991 Zuckerman .
5,076,016 12/1991 Adams et al. ..... 49/360
5,105,131 4/1992 Schap .
5,138,795 8/1992 Compeau et al. .
5,140,316 8/1992 DeLand et al. .
5,142,823 9/1992 Brandenburg et al. .
5,155,937 10/1992 Yamagishi et al. .
5,172,947 12/1992 Schap ..... 292/341.16
5,189,839 3/1993 DeLand et al. .
5,203,112 4/1993 Yamagishi et al. .
5,216,838 6/1993 Deland et al. .
5,222,775 6/1993 Kato .
5,232,253 8/1993 Tamiya .
5,253,451 10/1993 Hörmann .
5,285,596 2/1994 Kinsey .
5,316,365 5/1994 Kuhlman et al. .
5,319,880 6/1994 Kuhlman .
5,319,881 6/1994 Kuhlman .
5,323,570 6/1994 Kuhlman et al. .
5,361,540 11/1994 Rogers, Jr. et al. .
5,389,920 2/1995 DeLand et al. .
5,522,626 6/1996 Dominique ..... 292/DIG. 23

POWER STRIKER WITH INERTIALLY ACTIVATED IMPACT CYCLE

This application is a CONTINUATION of application Ser. No. 08/575,644, filed on Dec. 20, 1995 now abandoned.

RELATED APPLICATIONS

This application is related to U.S. patent application Ser. No. 08/501,557 filed Jul. 12, 1995 for "Acceleration Reaction Clutch With Override Capability" and Attorney Docket number AESI4425 (ITT-280-A) filed contemporaneously herewith for "Power Drive For A Movable Closure With Ball Nut Flexible Cable" and Attorney Docket No. AESI4440 (ITT-281-A) filed contemporaneously herewith for "Power Drive For A Movable Closure With Ball Nut Drive Screw".

FIELD OF THE INVENTION

The present invention relates to a power striker apparatus for engaging a striker with a latch to inertially move the striker with respect to the latch from a secondary latch position to a primary latch position, and in particular, to an apparatus and method for inertially moving the striker and latch with respect to one another from a secondary latch position to a primary latch position and for moving a sliding door of a vehicle from a location adjacent to the closed position to a fully closed position in sealed engagement with the frame around the periphery of the door opening of the vehicle.

BACKGROUND OF THE INVENTION

A typical standard automotive door latch assembly includes a striker, which can take the form of a pin or a U-shaped member, fixedly mounted in the door frame to project into the door opening and into the path of movement of a latch member mounted on the edge of the door, which includes the fork bolt therein. The latch member is typically movably mounted with respect to the door and arranged so that as the door approaches its closed position, the latch member will engage the striker and further closing movement of the door will move the latch member into safety latch position with respect to the pin, sometimes referred to as the secondary latch position, and further closing movement of the door will move the latch member into a primary latch position with respect to the pin, which positively retains the door against movement away from its closed position. It is generally known for at least part of the movement of the latch member into latched relationship with the striker to be resisted by a spring, and many users of sliding doors of this type habitually close the door with far greater force than necessary to overcome the spring bias. Greater force is generally required in the case of sliding doors, such as those employed in vans, where movement of the door through the final phase of movement to the fully closed position must compress a resilient door seal which extends around the entire periphery of the door opening.

Power striker devices have been proposed to overcome the high force requirements to move sliding doors into the fully closed position. Typically, the power striker devices are mounted on the door frame for powered movement between an outboard ready position with respect to the vehicle center line where the latch is engaged with the striker and an inboard holding position where the striker holds the latch door in the fully closed position. It is still required in such systems to use high force or momentum in order to ensure that the latch engages the striker in the primary latch position prior to movement into the fully closed position. When the door is open, the striker is located in its outboard ready position. After closing translation of the door is complete, the latch on the door engages the striker and latches the door to the striker while the striker is still in the outboard position. The door may engage a limit switch on the door frame when in the outboard position to actuate a drive motor which, through appropriate mechanism, drives the striker to its inboard position, such that the latched engagement between the door and striker enables the pin to drive the door to the fully closed position. With this arrangement, a closing force sufficient to engage the latch to the primary latch position with respect to the striker needs to be applied. The powered movement of the striker provides the force necessary to compress the door seal. If the striker and latch do not reach the primary latch position with respect to one another, the powered movement of the striker from its outboard position to its inboard position would not be sufficient to bring the door to the fully closed position in sealed engagement with the frame around the periphery of the door opening. In such cases, the user may be required to reopen and close the door repeatedly until the latch and striker are disposed in the primary latch position with respect to each other when in the outboard position.

SUMMARY OF THE INVENTION

A power striker apparatus according to the present invention includes an optionally controlled inertially activated impact cycle for engaging a striker, such as a pin or U-shaped member, with respect to a latch including a fork bolt movable from a secondary latch position to a primary latch position. The best door seals typically offer higher closing resistance, and require a large force or high momentum to close the doors. Often, a normal effort will only latch the striker in the secondary latch position, sometimes referred to as the safety latch position, even when the latching system is equipped with a power striker that allows striker engagement 12 mm to 25 mm away from the fully closed position where the door is in sealed engagement with the frame around the periphery of the door opening. The present invention provides means for snapping the spring loaded power striker into the door, when partially closed in the secondary latch position, causing the striker to move with respect to the fork bolt, such that the fork bolt moves into the primary latch position before the door can move outward from the inboard position. The power striker is then reactivated to pull the door into the fully closed inboard position in sealed engagement with the frame around the periphery of the door opening. The present invention eliminates the need for the operator to reopen and re-slam the door in order to bring the striker into the primary latch position with respect to the latch prior to operation of the power striker.

The power striker apparatus according to the present invention moves the engagement striker, such as a bolt pin or U-shaped bolt, outboard to ensure that the striker reaches the primary latch position with respect to the latch mechanism prior to the power striker being reactivated to draw the door into the fully closed and sealed position. If the striker and latch mechanism are only engaged in the secondary latch position, or safety position, normally the door must be reopened and a second attempt at closing the door must be attempted by the operator. The present invention provides means for snapping or restriking the striker member outward to quickly drive the striker into the primary latch position with respect to the door latch mechanism before the door has a chance to move outward. This method of operation could produce audible sounds, and therefore, would be activated only if the striker and latch mechanism did not achieve the primary latch position, or if the required door velocity to latch the striker into the primary latch position with respect to the latch mechanism is not normally achievable. The present invention may include a method of determining whether primary or secondary latch positions have been achieved, by monitoring the minimum amount of time required to achieve the desired position. A longer time period would be associated with reaching a primary latch position, since the force to close is higher and higher torque is required of the motor and associated gear box, slowing the motor and associated gear box, thereby requiring more time to close when in the primary latch position. In the alternative, the door ajar switch can be used as an input signal to the controller logic to determine if the door is successfully closed.

The present invention can include biasing means for preloading a striker arm clockwise towards a stop, where the striker pin will be in a first position. The biasing means, such as a spring, is reacted against a spring pin and is centered on a pivot member. Motor means is also provided for driving a worm and gear assembly which in turn drives a second worm and gear assembly. The gear portion of the second worm and gear assembly is pinned to a drive arm which carries a roller fastened thereto. When the drive arm is driven clockwise, the roller is caused to engage the roller cam, the striker arm is caused to rotate counterclockwise from the first position to a second position, where a switch means is provided for signaling a controller means for stopping the motor with the roller in a second position and the striker pin in a second position. At this point, the door system logic controller means is provided for determining if the door is closed, and if the door latch fork bolt is in the primary position. If the door latch fork bolt or striker is in the primary position, the controller means will reset and be prepared to operate the striker clockwise from the second position to the first position by rotating the drive arm counterclockwise from the second position to the first position when it is desired to open the door. This typically would be a quiet operation. If the fork bolt is determined to be in the partially latched secondary position, sometimes referred to as the safety latch position, through a separate motor, actuator, controller logic, then the drive arm is rotated clockwise beyond the second position, such that the roller rotates past the end of the cam surface and the striker arm is spring propelled to inertially snap back to the first position against the stop. The spring load and striker arm inertia must be sufficient to carry the fork bolt or striker into the primary position. The drive arm then continues clockwise until it engages the roller cam at the first position, where it is ready for another cycle to move the door into the fully closed position with the latch and pin in the primary latch position.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

The construction of a movable closure assembly including a fixed frame defining a portal through a barrier, where the movable closure is mounted on the frame for movement along a fixed path between a first end limit of movement obstructing the portal and a second end limit of movement allowing ingress and egress through the portal are well known and commercially available from a variety of sources. The present invention is directed to certain components of a power drive system by means of which a movable closure, such as a sliding door, hatch, roof panel, window or the like can be power driven into a primary latch position and fully closed position in sealed engagement with the frame around the periphery of the portal, such as a door opening for a sliding door of a vehicle. Various details of such sliding door structures and power drive systems can be obtained from U.S. patent application Ser. No. 08/501,557 filed Jul. 12, 1995 for "An Acceleration Reaction Clutch With Override Capability" which is incorporated by reference herein in its entirety.

Typically, a barrier, such as a wall of a vehicle, for example a van-type vehicle, has a movable closure, such as a sliding door located on at least one side of the vehicle. Vans using such sliding doors have been available for years and the structural arrangements by which the doors are mounted on the vehicle for movement between the closed position, where the door is sealingly seated in a door opening, and an open position, where the door is disposed at the side of the van rearwardly of the door opening are well known. In the standard arrangement, the door is latched in its closed position, typically by mechanical latches at the front and rear edges of the door, and the latches are mechanically linked to a latch actuator mounted within the door to be simultaneously released by actuation of manually operated door handles, or electronically as part of a power door drive system. In many cases, the rear latch may include a power driven striker mechanism which is latchingly engaged with the door as it approaches its closed position and is power driven to move the latched door to its fully closed position. The employment of an electronic control unit enables the power drive for the door to be operated in a safe and efficient manner, as by providing the door with an anti-pinch capability by automatically stopping the drive if an object becomes trapped between the closing door and the door frame, providing for express operation and eliminating the need for limit switches to sense specific door positions. Electronic control units capable of being programmed to perform these, and similar functions, are well known and commercially available from a variety of sources.

Figure 5:
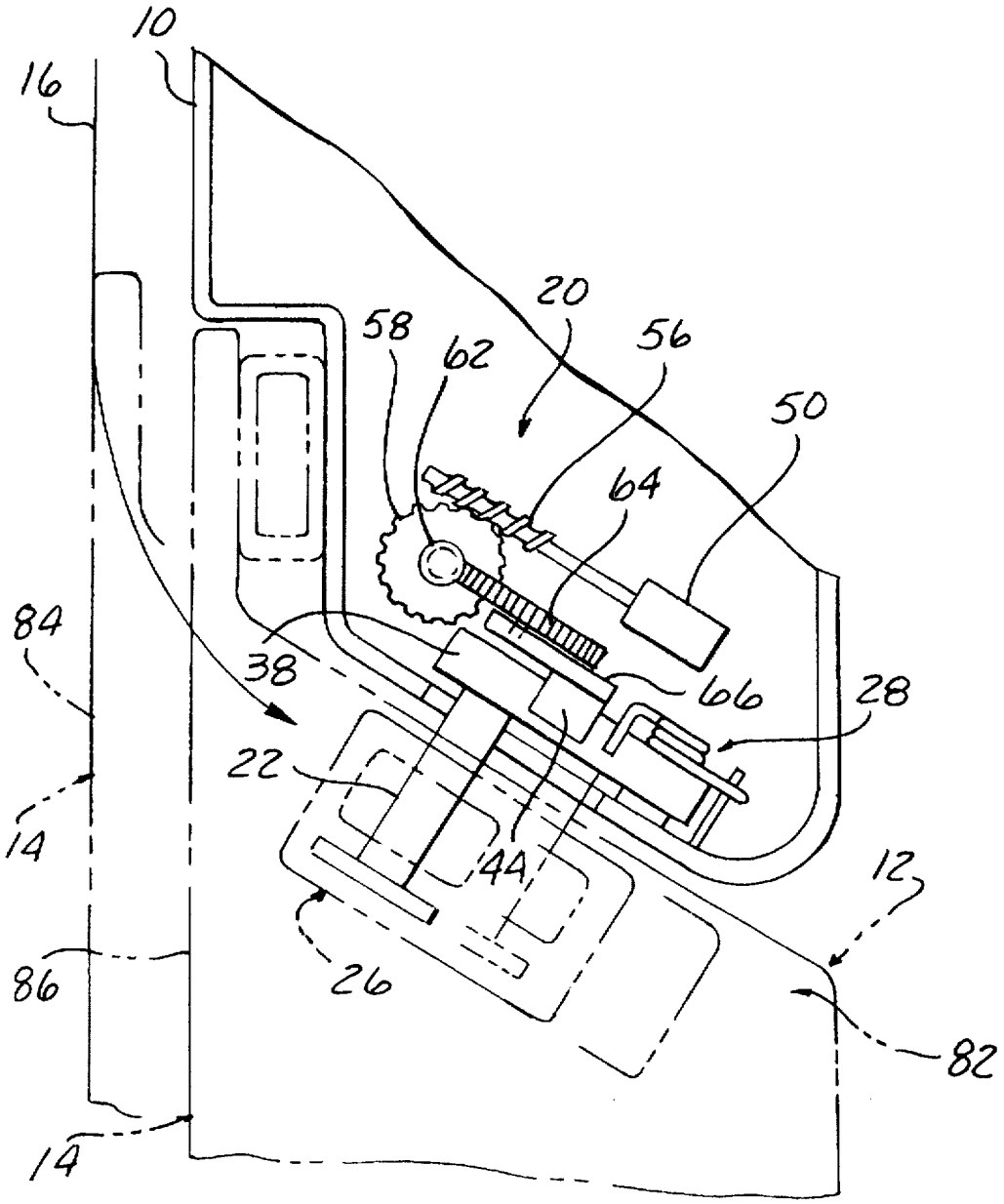
FIG. 5 is a simplified cross-sectional view of the power striker apparatus connected to a portal through a barrier, such as the door frame of a vehicle for a sliding door latch assembly.

The barrier is a construction forming an extended indefinite surface preventing or inhibiting the passage of persons or things, and can include a wall, ceiling, roof or cover for a stationary structure or a movable vehicle, such as the vertically extending wall 10 of a van-type vehicle illustrated in cross-section in FIG. 5. The portal is structure defining an opening 12 through the barrier for passage of persons or things, such as the framing of a door, window, hatch or roof panel opening. The movable closure 14 is an obstructive structure whose presence in or before a passage bars traffic through the passage and is mounted to move in a regular, repetitive, predetermined path 16 with respect to the opening 12 so as to alternately open or close the passage, and can take the form of a hatch, a sliding window, a roof panel or a sliding door.

Figure 1:
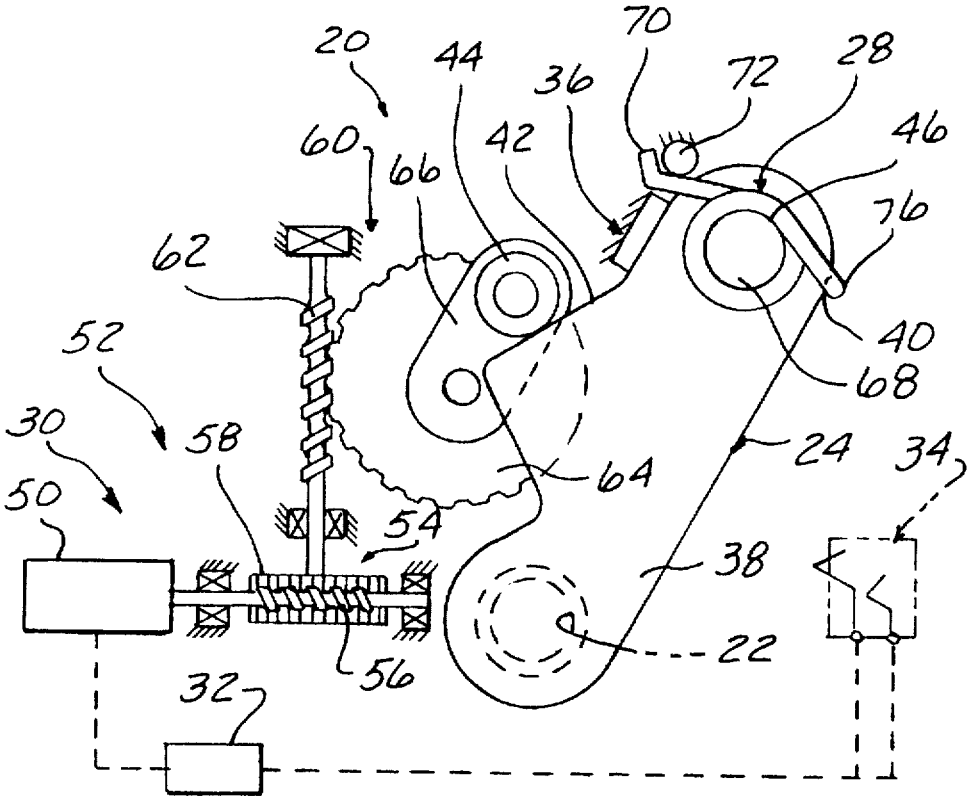
FIG. 1 is a simplified schematic view of a power striker in a first position according to the present invention.
Figure 2:
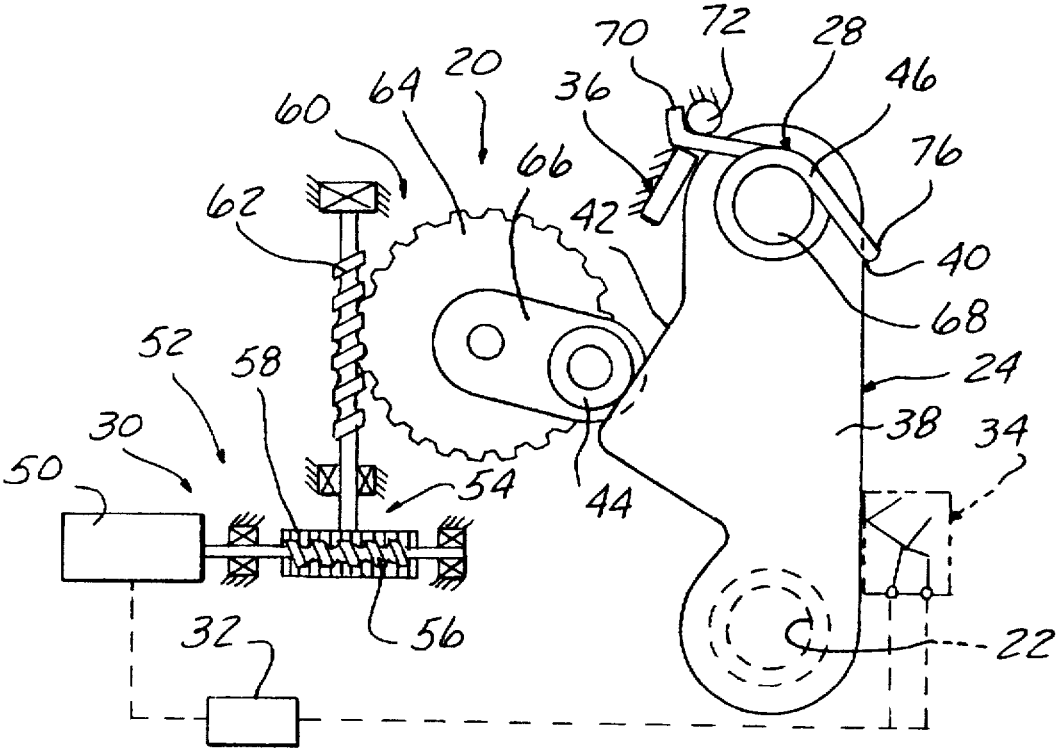
FIG. 2 is a simplified schematic view of a power striker in a second position according to the present invention.

Referring now to FIGS. 1 and 2, a simplified schematic of a power striker apparatus 20 is illustrated. In FIG. 1, the power striker apparatus 20 is shown with the striker 22, such as a striker pin, fork bolt, U-shaped striker or the like, in a first outboard position with respect to a longitudinally extending center line of the vehicle. FIG. 2 illustrates the power striker apparatus 20 with the striker 22 in a second position corresponding to an inboard position with respect to a longitudinally extending center line of the vehicle. Base means 24 is provided for supporting the striker 22 for movement between the first position illustrated in FIG. 1 and the second position illustrated in FIG. 2 with respect to the latch mechanism 26 illustrated in phantom in FIG. 5. Biasing means 28 urges the base means 24 toward the first position. Drive means 30 operably moves the base means 24 from the first position against the urging of the biasing means 28 toward the second position. The drive means 30 in response to further clockwise movement of the illustrated embodiment can selectively release the base means 24 when in the second position, such that the striker 22 snaps back to the first position in response to the urging of the biasing means 28 to inertially drive the striker 22 into the primary latch position from the secondary latch position with respect to the latch mechanism 26. Control means 32 operably actuates the drive means 30 for moving the base means 24 between the first and second positions. Sensor means 34 signals when the base means 24 is in the second position. Stop means 36 limits movement of the base means 24 to define the first position and absorbs impact from the base means 24 during return movement to the first position from the second position.

Figure 3:
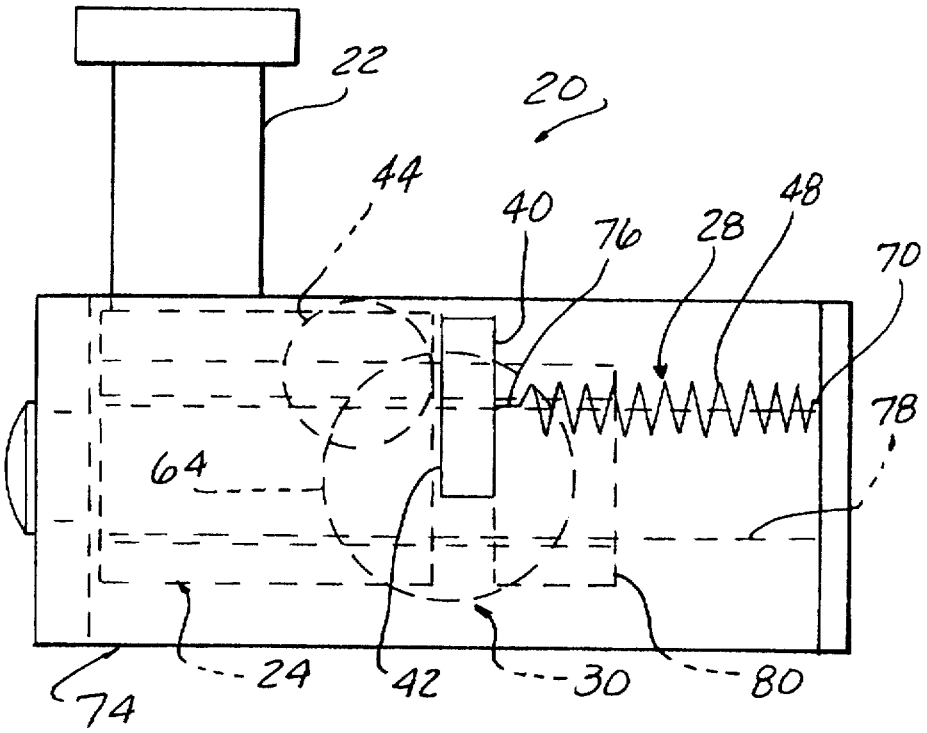
FIG. 3 is a simplified schematic view of an alternative configuration for a power striker apparatus in the first position according to the present invention.
Figure 4:
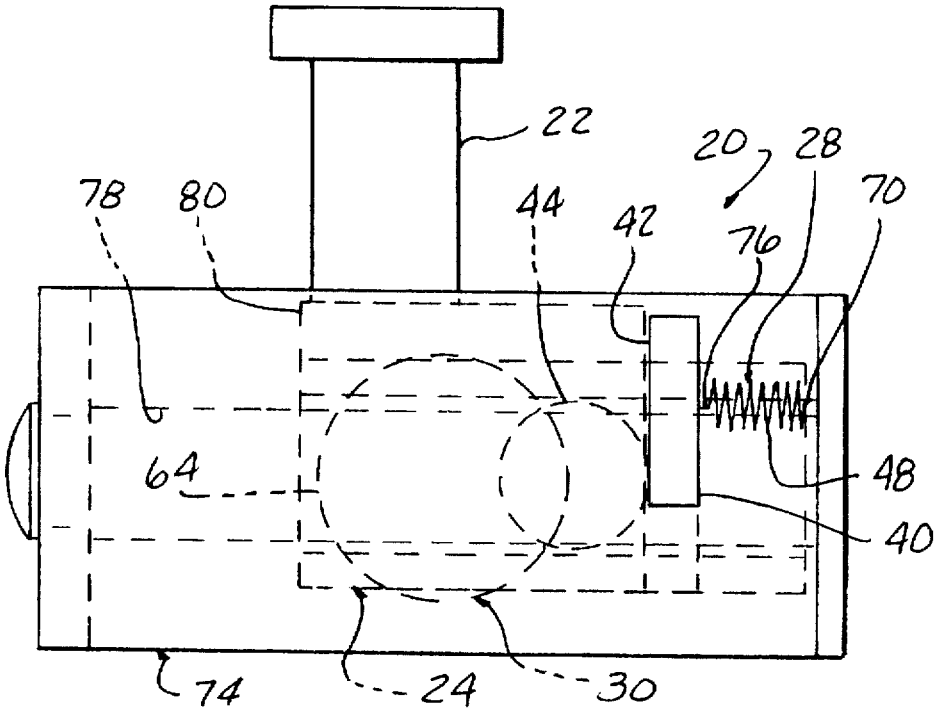
FIG. 4 is a simplified schematic view of the alternative configuration of the power striker apparatus in the second position according to the present invention.

In the preferred embodiment illustrated in FIGS. 1, 2 and 5, the base means 24 can include a rotatable arm 38 for supporting the striker 22 for movement between the first and second positions. The arm 38 can include a seat 40 and a cam surface 42 formed thereon. The biasing means 28 operably engages with the seat 40 of the arm 38 for urging the arm 38 toward the first position. The drive means 30 preferably includes a roller 44 engageable with the cam surface 42 for moving the arm 38 between the first and second positions. The biasing means 28 can include a spring, such as a torsion spring 46 as illustrated in FIGS. 1 and 2, or a compression spring 48 as illustrated in FIGS. 3 and 4. The drive means 30 best seen in FIGS. 1, 2 and 5 preferably includes an electric motor 50 for powering movement of the base means 24 between the first and second positions. Gear means 52 operably connects the electric motor 50 and base means 24 for transferring movement from the motor 50 to the base means 24. The gear means 52 may include a first worm and gear assembly 54 having a first worm 56 and a first gear 58 operably intermeshing with one another. The electric motor drives the first worm 56 in rotation about its longitudinal axis, which in turn rotates the first gear 58 about an axis which is illustrated at a 90° angle with respect to the worm gear axis in FIGS. 1 and 2. The first gear 58 is connected to a second worm and gear assembly 60 including a second worm 62 and a second gear 64. The first gear 58 drives the second worm 62 about its longitudinal axis, which in turn operably intermeshingly engages with the second gear 64 to rotate about an axis disposed at 90° with respect to the longitudinal axis of the second worm as illustrated in FIGS. 1 and 2. A drive arm 66 is connected to the second gear 64 for rotation therewith. The roller 44 is connected to the drive arm 66 spaced radially outward from the rotational axis of the second gear 64. The roller 44 operably engages the cam surface 42 formed on the rotatable arm 38 supporting the striker 22. The rotatable arm 38 is pivotable about pivot member 68. The biasing means 28 is anchored at one end 70, such as against spring pin 72 illustrated in FIGS. 1 and 2, or a wall of housing 74 illustrated in FIGS. 3 and 4, while the opposite end 76 of the biasing means 28 urges the base means 24 toward the first position. As illustrated in FIGS. 1 and 2, the torsion spring 46 is centered on the pivot member 68.

Referring now to FIGS. 3 and 4, the base means 24 can include a housing 74 having a slot or pin 78 disposed therein. A slidable plate 80 can be engaged within the pin 78 of the housing 74 for movement between the first position illustrated in FIG. 3 and the second position illustrated in FIG. 4. The plate 80 supports the striker 22 with respect to the latch mechanism 26 illustrated in phantom in FIG. 5. The plate 80 preferably has a seat 40 and a cam surface 42 formed thereon. The biasing means 28 operably engages between the seat 40 and the housing 74 for urging the plate 80 toward the first position. The drive means 30 preferably includes a roller 44 operably engageable with the cam surface 42 for moving the plate 80 between the first and second positions. The biasing means 28 can take the form of a compression spring 48 with one end 70 disposed against a wall of the housing 74 and an opposite end 76 operably engageable with the seat 40 of the base means 24. For purposes of clarity, portions of the drive means 30, control means 32 and sensor means 34 have been removed and not illustrated in FIGS. 3 and 4. It should be understood that the drive means 30, control means 32 and sensor means 34 can take the same form as that illustrated in FIGS. 1 and 2, or any other suitable form for moving the base means 24 between the first and second positions. For purposes of illustration, the second gear 64 and roller 44 are illustrated in FIGS. 3 and 4 with the remaining portions, such as electric motor 50, gear means 52, first worm and gear assembly 54, second worm 62 and drive arm 66 not illustrated. It should be recognized from the illustration and description of FIGS. 1–4 that the present invention may be used on a rotatable power striker apparatus 20 as illustrated in FIGS. 1 and 2, or a linear sliding power apparatus 20 as illustrated in FIGS. 3 and 4.

Figure 6:
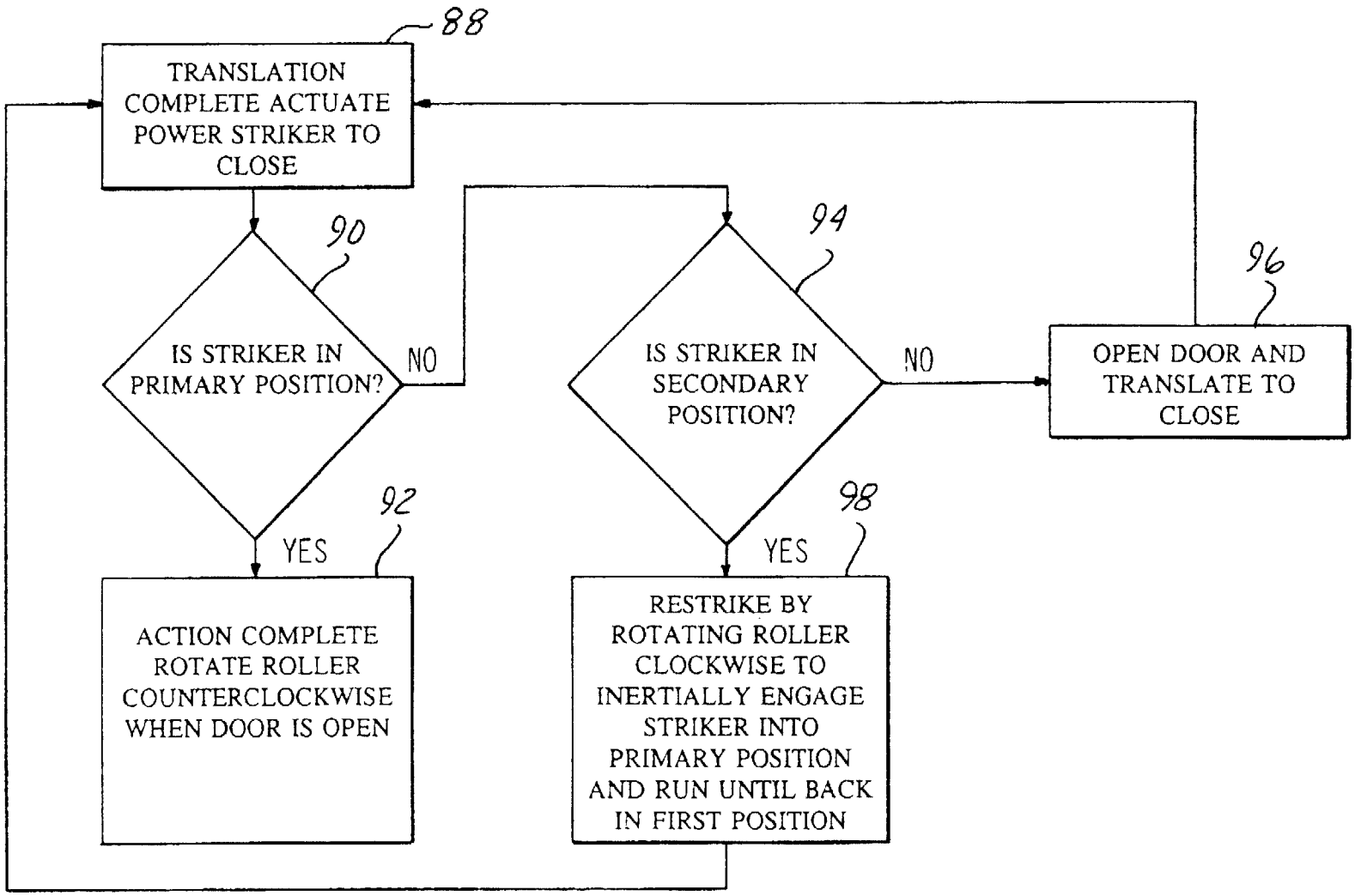
FIG. 6 is a flow diagram of a method of operating and controlling the power striker apparatus according to the present invention.

Referring now to FIGS. 5 and 6, in operation the present invention encompasses an apparatus and method for inertially moving the latch and striker means 82 from a secondary latch position to a primary latch position and for moving the movable closure 14 from a location 84 adjacent the closed position to the fully closed position 86 in sealed engagement with the frame around the periphery of the opening 12. The method of operation of a power striker apparatus 20 according to the present invention includes the steps of inertially moving the latch and striker means 82 from a secondary latch position to a primary latch position, and moving the movevable closure 14 from the location 84 adjacent the closed position to the fully closed position 86 in sealed engagement with the frame around the periphery of the opening 12.

As best seen in the simplified flow diagram illustrated in FIG. 6, after closing translation of the moveable closure 14 is complete, the drive means 30, as seen in FIGS. 1, 2 and 5, is actuated to move the striker 22 from the first position to the second position as illustrated in step 88 of FIG. 6. With the striker 22 in the second position, the control means 32, seen in FIGS. 1 and 2, determines whether the latch 26 is in the primary latch position with respect to the striker 22 as illustrated in the first inquiry step 90 of FIG. 6. If the control means 32 determines that the latch 26 is in the primary latch position with respect to the striker 22, the control program progresses to step 92 indicating that action is complete and the control means 32 resets so that the roller 44 can be rotated counterclockwise when it is desired by the operator for the moveable closure to open. If the latch 26 is determined by the control means 32 not to be in the primary latch position with respect to striker 22, the method of operation progresses to the second inquiry step 94 where the control means 32 determines whether the latch 26 is in the secondary latch position with respect to the striker 22. If the control means 32 determines that the latch 26 is not in the secondary latch position with respect to the striker 22, the control method progresses to step 96 to signal the moveable closure is ajar to indicate that the moveable closure needs to be manually or automatically recycled to the open position and translated back to the closed position and the control program returns to the initial step 88. If the control means 32 determines that the latch 26 is in the secondary latch position with respect to the striker 22, the control means 32 restrikes the striker 22 with respect to the fork bolt of the latch mechanism 26 as indicated in step 98 by continuing to rotate the roller 44 clockwise beyond the second position illustrated in FIGS. 2 and 4, so that the roller 44 disengages from the cam surface 42 to cause the base means 24 to be driven from the second position to the first position by the biasing means 28. This action dynamically engages the striker 22 with respect to the fork bolt to move the fork bolt into the primary latch position with respect to the striker 22 before the moveable closure 14 with a higher inertia can move in the outboard direction. The roller 44 is rotated clockwise until it returns to the first position illustrated in FIGS. 1 and 3 and the control program is returned to step 88 so that the drive means 30 is actuated to drive the roller 44 clockwise to move the striker 22 from the first position to the second position with the latch 26 now in the primary latch position with respect to the striker 22 thereby pulling the moveable closure 14 into the fully closed position 86 with respect to the opening 12 in the barrier 10.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A power striker apparatus for engaging a striker with a latch to move said striker with respect to said latch from a secondary latch position, wherein said striker is partially engaged with said latch, to a primary latch position, wherein said striker is fully engaged with said latch, comprising:

base means for supporting said striker for movement between a first position and a second position with respect to said latch;

biasing means for urging said base means toward said first position; and drive means for moving said base means from said first position against said urging of said biasing means toward said second position and for selectively releasing said base means when in said second position, such that said base means snaps back to said first position in response to said urging of said biasing means, said base means when snapped back adapted to drive said striker into said primary latch position with respect to said latch from said secondary latch position, while said latch remains temporarily stationary.

2. The apparatus of claim 1 further comprising:

control means for actuating the drive means for moving the base means between the first and second positions; and sensor means for signalling when the base means is in the second position.

3. The apparatus of claim 1 further comprising:

stop means for limiting movement of said base means to define said first position and for absorbing impact of said base means during return movement to said first position from said second position.

4. The apparatus of claim 1 wherein said base means further comprises:

a housing;

a slidable plate engaged within said housing for movement between said first and second positions, said plate supporting said striker with respect to said latch.

5. The apparatus of claim 4 further comprising:

said plate having a seat formed thereon; and said biasing means engaged between said seat and said housing for urging said plate toward said first position.

6. The apparatus of claim 1 wherein said biasing means is a spring.

7. The apparatus of claim 1 wherein said base means further comprises:

a rotatable arm supporting said striker for movement between said first and second positions, said arm having a seat formed thereon; and said biasing means engaged with said seat for urging said arm toward said first position.

8. The apparatus of claim 7 further comprising:

said arm having a cam surface formed thereon; and said drive means having a roller engageable with said cam surface for moving said arm between said first and second positions.

9. The apparatus of claim 1 wherein said drive means further comprises:

an electric motor for powering movement of said base means between said first and second positions.

10. The apparatus of claim 9 further comprising:

gear means connected between said motor and said base means for transferring movement from said motor to said base means.

11. An apparatus for engaging a striker with a latch to move said striker with respect to said latch from a secondary latch position to a primary latch position comprising:

base means for supporting said striker for movement between a first position and a second position with respect to said latch, wherein said base means further includes a housing, a slidable plate engaged within said housing for movement between said first and second positions, said plate supporting said striker with respect to said latch, said plate having a seat formed thereon, and said plate having a cam surface formed thereon;

biasing means for urging said base means toward said first position, said biasing means engaged between said seat and said housing for urging said plate toward said first position; and drive means for moving said base means from said first position against said urging of said biasing means toward said second position and for releasing said base means when in said second position, such that said base means snaps back to said first position in response to said urging of said biasing means for driving said striker into said primary latch position with respect to said latch from said secondary latch position, said drive means having a roller engageable with said cam surface for moving said plate between said first and second positions.

12. A method for engaging a power operated striker with a latch to move said striker with respect to said latch from a secondary latch position, wherein said striker is partially engaged with said latch, to a primary latch position, wherein said striker is fully engaged with said latch, comprising the steps of:

actuating drive means to move base means supporting said striker from a first position to a second position;

sensing if said striker is in said primary latch position;

if in said primary latch position, resetting said drive means for movement of said base means supporting said striker to said first position;

if not in said primary latch position, sensing if said striker is in said secondary latch position;

if in said secondary latch position, restriking said striker by moving said base means supporting said striker from said second position to said first position to engage said striker into said primary latch position, while said latch remains temporarily stationary, and then repeating said actuating step; and if not in said secondary latch position, signalling failure to engage said striker with said latch.

13. A power striker apparatus for a moveable closure assembly including a fixed frame defining a portal through a barrier, a moveable closure mounted on said frame for movement along a fixed path between a first end limit of movement wherein said closure is in a closed position obstructing said portal and a second end limit of movement wherein said closure is in an open position, said apparatus comprising:

a striker for attachment to one of said frame and said closure;

latch means for attachment to the other of said frame and said closure, said latch means engageable with said striker for releasably latching said closure in said closed position, said latch means operable during movement of said closure toward said closed position to interlock with said striker to releasably latch said closure against movement relative to said portal, said latch means engageable with said striker in a secondary latch position, wherein said striker is partially engaged with said latch means, and a primary latch position, wherein said striker is fully engaged with said latch means;

base means for supporting said striker for movement between a first position and a second position with respect to said latch means;

biasing means for urging said base means toward said first position; and drive means for moving said base means from said first position against said urging of said biasing means toward said second position and for selectively releasing said base means when in said second position, such that said base means snaps back to said first position in response to said urging of said biasing means, said base means when snapped back adapted to drive said striker into said primary latch position of said latch means from said secondary latch position, while said latch means remains temporarily stationary.

14. The apparatus of claim 13 further comprising:

control means for actuating the drive means for moving the base means between the first and second positions;

sensor means for signalling when the base means is in the second position; and stop means for limiting movement of said base means to define said first position and for absorbing impact of said base means during return movement to said first position from said second position.

15. The apparatus of claim 13 wherein said drive means further comprises:

an electric motor for powering movement of said base means between said first and second positions; and gear means connected between said motor means and said base means for transferring movement from said motor to said base means.

16. An apparatus for a moveable closure assembly including a fixed frame defining a portal through a barrier, a moveable closure mounted on said frame for movement along a fixed path between a first end limit of movement wherein said closure is in a closed position obstructing said portal and a second end limit of movement wherein said closure is in an open position, said apparatus comprising:

a striker for attachment to one of said frame and said closure;

latch means for attachment to the other of said frame and said closure, said latch means engageable with said striker for releasably latching said closure in said closed position, said latch means operable during movement of said closure toward said closed position to interlock with said striker to releasably latch said closure against movement relative to said portal, said latch means engageable with said striker in a secondary latch position and a primary latch position;

base means for supporting said striker for movement between a first position and a second position with respect to said latch means, said base means including a housing and a slidable plate engaged within said housing for movement between said first and second positions, said plate supporting said striker with respect to said latch means, a seat and a cam surface formed on said plate;

biasing means for urging said base means toward said first position, said biasing means engaged between said seat and said housing for urging said plate toward said first position; and drive means for moving said base means from said first position against said urging of said biasing means toward said second position and for releasing said base means when in said second position, such that said base means snaps back to said first position in response to said urging of said biasing means for dynamically driving said striker into said primary latch position of said latch means from said secondary latch position, said drive means having a roller engageable with said cam surface for moving said plate between said first and second positions.

17. An apparatus for a moveable closure assembly including a fixed frame defining a portal through a barrier, a moveable closure mounted on said frame for movement along a fixed path between a first end limit of movement wherein said closure is in a closed position obstructing said portal and a second end limit of movement wherein said closure is in an open position, said apparatus comprising:

a striker for attachment to one of said frame and said closure;

latch means for attachment to the other of said frame and said closure, said latch means engageable with said striker for releasably latching said closure in said closed position, said latch means operable during movement of said closure toward said closed position to interlock with said striker to releasably latch said closure against movement relative to said portal, said latch means engageable with said striker in a secondary latch position and a primary latch position;

base means for supporting said striker for movement between a first position and a second position with respect to said latch means, said base means including a rotatable arm supporting said striker for movement between said first and second positions, a seat and a cam surface formed on said arm;

biasing means for urging said base means toward said first position, said biasing means engaged with said seat for urging said arm toward said first position; and drive means for moving said base means from said first position against said urging of said biasing means toward said second position and for releasing said base means when in said second position, such that said base means snaps back to said first position in response to said urging of said biasing means for dynamically driving said striker into said primary latch position of said latch means from said secondary latch position, said drive means having a roller engageable with said cam surface for moving said arm between said first and second positions.

18. In a power striker apparatus for a sliding door assembly of a vehicle including a door frame defining a door opening, a door slidably mounted on said frame for movement between an open position wherein said door is withdrawn to one side of said opening and a fully closed position wherein said door is received in sealed engagement with said frame around the periphery of said door opening, the improvement comprising:

releasable latch and striker means on said door and frame for latching said door with respect to said frame in response to closing movement of said door to a location adjacent to said fully closed position and for latching said door in said fully closed position from said location adjacent to said fully closed position ; and means for selectively moving said latch and striker means from a secondary latch position, wherein said latch and striker means is partially engaged, to a primary latch position, wherein said latch and striker means is fully engaged, while one portion of said latch and striker means remains temporarily stationary with respect to another portion, and for moving said door from said location adjacent said closed position to said fully closed position in sealed engagement with said frame around the periphery of said door opening.

* * * * *